United States Patent [19]

Belcher

[11] 3,969,695

[45] July 13, 1976

[54] ELECTRIC FUSE AND TERMINAL PLUG THEREFOR

[75] Inventor: Richard A. Belcher, Hampton Falls, N.H.

[73] Assignee: The Chase-Shawmut Company, Newburyport, Mass.

[22] Filed: Aug. 6, 1975

[21] Appl. No.: 602,319

[52] U.S. Cl. ..... 337/236; 337/239; 337/254

[51] Int. Cl.[2] ..... H01H 85/16

[58] Field of Search ..... 339/255 R; 337/190, 337/231, 236, 239, 252, 253

[56] References Cited

UNITED STATES PATENTS

| | | | |
|---|---|---|---|
| 1,392,917 | 10/1921 | Conant | 337/236 |
| 1,396,297 | 11/1921 | Steele | 337/236 |
| 1,436,919 | 11/1922 | Smith | 337/236 |

FOREIGN PATENTS OR APPLICATIONS

| | | | |
|---|---|---|---|
| 689,050 | 6/1964 | Canada | 337/236 |

*Primary Examiner*—George Harris
*Attorney, Agent, or Firm*—Erwin Salzer

[57] ABSTRACT

A fuse for elevated circuit voltages, e.g. 4–34 kv, has a tubular insulating casing closed on both ends thereof by means of plug terminals. The latter are provided with blind bores of which each receives one end of a fusible element, a spring means for clamping said end of said fusible element against the lateral wall of said blind bore, and a solder joint conductively interconnecting said end of said fusible element and one of said plug terminals.

8 Claims, 10 Drawing Figures

R

ELECTRIC FUSE AND TERMINAL PLUG THEREFOR

BACKGROUND OF THE INVENTION

This invention relates to high-voltage fuses, and more particularly to such fuses having plug terminals closing the ends of the casing thereof and being conductively interconnected by fusible element means, e.g. silver ribbons. There are several ways of establishing conductive interconnections of the kind under consideration. A preferred prior art way of solving the problem is shown in U.S. Pat. No. 3,611,239; 10/05/71 to Frederick J. Kozacka for HIGH-VOLTAGE FUSE HAVING INNER CORE AND OUTER SHELL FUSE LINKS. As shown in the above patent, the ends of the fusible elements or fuse links are clamped by means of the heads of screws against the axially inner end surfaces of the plug terminals, and the gaps formed between the aforementioned screw heads and the axially inner end surfaces of the plug terminals are filled with soft solder. These soft solder joints perform the dual function of preventing the clamping screws from getting loose, and of minimizing the contact resistance between the fusible elements and the plug terminals. One limitation of the above structure consists in the need of providing an internal thread in each bore intended to receive a fuse-link-connecting screw. As long as the number of fusible elements, or fuse links, that are connected in parallel between the plug terminals of a high-voltage fuse is small, the bore tapping operations are an undesirable, though still acceptable increase in the cost of production. The larger the number of fusible elements connected in parallel between the plug terminals of a high-voltage fuse, the higher the increase in production cost due to the need of performing a large number of tapping operations.

It is, therefore, one object of this invention to provide electric fuses having terminal plugs which fuses do not require tapping or screw-threading operations at the interfaces between the fusible elements and the plug terminals thereof.

Another object of this invention is to provide high-voltage fuses including simple spring means for maintaining pressure between the plug terminals and the fusible elements while both are conductively interconnected by solder joints.

A further object of this invention is to provide fuses which lend themselves particularly well to, and allow to simplify, the fuse assembly process disclosed and claimed in U.S. Pat. No. 3,848,214; 11/12/74 to Erwin Salzer for METHOD OF ASSEMBLING ELECTRIC HIGH-VOLTAGE FUSES AND SUBASSEMBLY THEREFOR.

Other objects and advantages of the invention will become apparent from what follows.

SUMMARY OF THE INVENTION

In fuses embodying this invention the axially inner end surfaces of a pair of plug terminals are provided with blind bores engaged by the axially outer ends of the fusible element means and also engaged by spring means tending to clamp said axially outer ends of said fusible element means against the lateral walls of said blind bores. Fuses embodying this invention further include soft solder joints formed inside said blind bores conductively connecting the axially outer ends of said fusible element means to said pair of plug terminals.

DESCRIPTION OF PREFERRED EMBODIMENTS

Figures 1, 2, 3, 4, 5, 6, 7, 8, 9, 10:
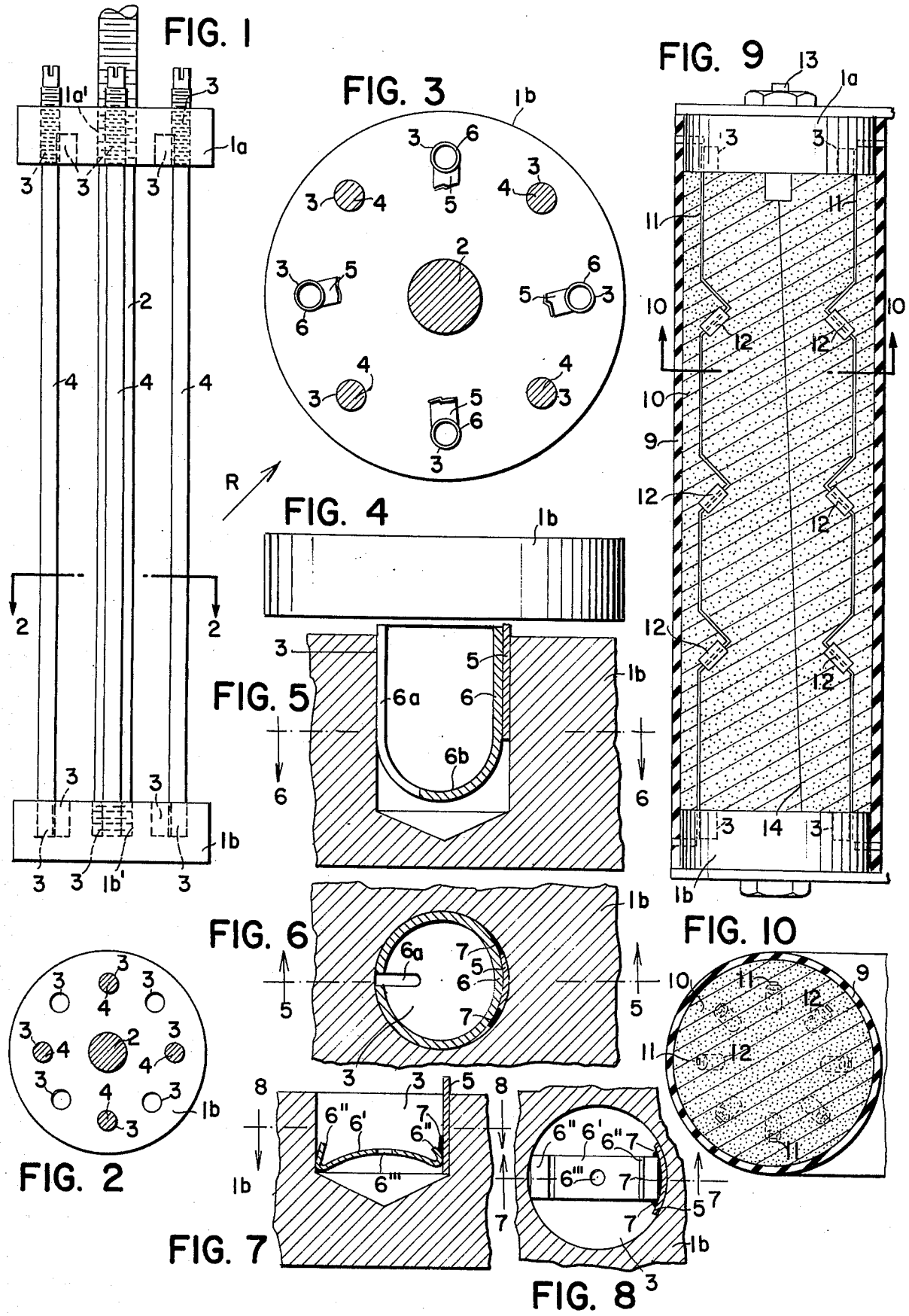
FIG. 1 shows in side elevation (seen in the direction of arrow R of FIG. 3) a fixture and parts for assembling fuses in accordance with the above U.S. Pat. No. 3,848,214.
FIG. 2 is a section along 2—2 of FIG. 1.
FIG. 3 is a top-plan view of the lower plug terminal of the structure of FIG. 1 upon providing the fixture with four helically wound fusible elements which are connected in parallel.
FIG. 4 is a side elevation of the plug terminal of FIG. 3 as such, i.e., without any parts affixed to it.
FIG. 5 is a vertical section taken along 5—5 of FIG. 6 and shows a preferred fashion of conductively connecting the end of a fusible element to a plug terminal.
FIG. 6 is a cross-section of the structure of FIG. 5 taken along 6—6 of FIG. 5.
FIG. 7 shows a modification of the structure of FIGS. 5 and 6 and is a section along 7—7 of FIG. 8.
FIG. 8 is a section along 8—8 of FIG. 7.
FIG. 9 shows partly in vertical section and partly in side elevation a fuse embodying the present invention.
FIG. 10 is a section along 10—10 of FIG. 9.

Referring now to FIGS. 1–4, characters 1*a*, 1*b* have been applied to indicate a pair of spaced plug terminals. Plug terminals 1*a*, 1*b* are spaced by a center post 2 having external screw-threads on both ends. The external screw-threads on the lower end of center post 2 engage an internally screw-threaded recess 1*b*′ in plug terminal 1*b* and the upper externally screw-threaded end of center post 2 projects through an internally screw-threaded passageway 1*a*′ in plug terminal 1*a*. Both plug terminals 1*a*, 1*b* are provided with eight axially extending bores 3 which are angularly displaced 45 deg. It may be assumed that the bores in plug terminal 1*a* are alternately internally screw-threaded and non-internally screw-threaded, and that the screw-threaded bores project all the way through plug terminal 1*a*, while the non-screw-threaded bores 3 are blind bores. All the bores 3 in lower plug terminal 1*a* are blind bores and non-screw-threaded. Reference numeral 4 has been applied to indicate four metal rods having lower ends projecting into the blind bores 3 in plug terminal 1*b* and having upper externally screw-threaded ends projecting through the internally screw-threaded bores 3 in plug terminal 1*a*. Plug terminals 1*a*, 1*b* and rods 4 form a squirrel-cage-like structure. Rods 4 serve as a temporary mandrel intended to support temporarily four ribbon fuse links (not shown) which are wound helically around rods 4 (as shown in U.S. Pat. No. 3,848,214 referred-to above).

In FIG. 3 reference numeral 5 has been applied to indicate the lower ends of the aforementioned four fuse links or fusible elements. These ends are inserted into bores 3 which are not occupied by rods 4. Blind bores 3 are further engaged by compression spring means 6 tending to clamp the ends 5 of the fusible elements against the lateral walls of bores 3. As shown in FIGS. 5 and 6 the spring means 6 are substantially cylindrical and have a lateral slit 6*a* coextensive with a generatrix thereof. FIGS. 5 and 6 further show that spring means 6 have a dome-shaped tip 6*b* arranged adjacent the closed bottom ends of bores 3. This dome-shaped tip forms a guide means for inserting springs 6 into bores 3.

Reference numeral 7 has been applied to indicate soft solder joints formed inside of bores 3 conductively connecting the axially outer ends 5 of the fusible element means to plug terminals 1*a* and 1*b*. As is apparent from FIG. 6 long narrow channels are formed between parts 5 and 6 and the side walls of blind bores 3 into which liquefied solder is abundantly sucked by capillary action. Thus a pair of soft solder joints 7 is formed which extend along the lateral edges of the ends 5 of the ribbon fuse links and connect the latter conductively to parts 1*a*, 1*b*.

It will be understood that the upper ends of the fusible elements are conductively connected to the upper plug terminal 1*a* in the same fashion as the lower ends of the fusible elements are conductively connected to the lower plug terminal 1*b*.

After having conductively interconnected terminals 1*a*, 1*b* by one fusible element, or by a plurality of fusible elements, the fuse structure is completely assembled by sequentially performing the following steps as set forth in detail in the aforementioned U.S. Pat. No. 3,848,214.

a. Plugs 1*a*, 1*b* are inserted into a tubular insulating casing and pinned to it, which allows removal of center post 2;

b. Upon removal of center post 2 the casing is filled with a pulverulent arc-quenching filler through the aperture in plug terminal 1*a* vacated by the removal of center post 2;

c. After the casing has been filled with a pulverulent arc-quenching filler, the latter supports the helically wound fusible elements. This, in turn, allows removal of the four temporary supporting rods 4 from the casing.

The bores 3 for receiving rods 4 and the bores 3 for receiving the ends 5 of the fusible elements may be drilled very simply by a gang drill press in one operation, or several sequential operations, and the bores for receiving rods 4 and those for receiving the ends of the fusible elements may have the same diameter, which significantly contributes to the speed of production. The spacing of all the bores 3 from the centers of plug terminals 1*a*, 1*b* should be equal.

It will be understood that bores 3 may enclose any desired angle with the end surfaces of parts 1*a*, 1*b*. For practical manufacturing reasons that angle will be 90°. If the portions of the fusible elements outside bores 3 are helical and the portions of the fusible elements inside bores 3 are at right angles to the end surfaces of parts 1*a*, 1*b*, there must be a bent in the fusible elements at the point of transition of direction. This bent has not been shown in FIG. 3 which is diagrammatic in this respect.

If desired, the structure of FIGS. 7 and 8 may be substituted for that of FIGS. 5 and 6. As shown in FIGS. 7 and 8 terminal plug 1*b* is provided with a blind bore, or blind bores 3 into which one end 5 of a fusible element is inserted. The end 5 of the fusible element is clamped by a leaf spring 6′ against the lateral wall of blind bore 3. The ends 6″ of leaf spring 6′ are bent so as to enclose acute angles with the center thereof, and the center of leaf spring 6′ is provided with a perforation 6‴. This geometry of leaf spring 6′ facilitates its insertion into a blind bore 3 and also facilitates clamping of part 5 against the lateral wall of bore 3. A soft solder joint 7 formed inside of bore 3 connects the axially outer end 5 of the fusible element to plug terminal 1*b*. The configuration of solder joint 7 is clearly shown in FIG. 8.

As shown above, the conductive connection between fusible elements and plug terminals 1*a*, 1*b* illustrated in FIGS. 5–8 is particularly desirable in instances where the plug terminals are provided with temporary supporting rods 4 for winding fusible elements around them. The invention is, however, not limited to high-voltage fuses of this description. This has been illustrated in FIGS. 9 and 10. The fuse shown in FIGS. 9 and 10 includes a tubular casing 9 of electric insulating material, e.g. glass cloth melamine. Casing 9 contains a pulverulent arc-quenching filler 10, e.g. quartz sand. A plurality of fusible elements 11 is arranged inside of casing 9 and embedded in filler 10. The ends of casing 9 are closed by a pair of plug terminals 1*a*, 1*b* which are conductively interconnected by fusible elements 11. The latter support beads 12 at discrete points thereof to reduce the rate of heat dissipation at these points. The axially inner end surfaces of plug terminals 1*a*, 1*b* are provided with blind bores 3 engaged by the axially outer ends of fusible elements 11, and also engaged by spring means such as the spring means 6 shown in more detail in FIGS. 5 and 6. The structure of FIGS. 9 and 10 further includes soft solder joints as shown in FIGS. 5 and 6 for connecting the insides of bores 3 to the axially outer ends of fusible elements 11. The upper plug terminal 1*a* is provided with a blown fuse indicator which is spring-biased and normally held in the non-indicating position thereof (shown in FIG. 9) by a restraining wire 14.

Since in the structure shown in FIGS. 9 and 10 the ends of fusible elements 11 entering into bores 3 have the same direction as the latter, there are no bends in fusible elements 11 at the region of their entry into bores 3.

Referring now again to the structure of FIGS. 3, 4, 5 and 6, it will be apparent that plug terminal 1*b* includes a first plurality of axially extending angularly displaced bores which house fuse link connector means, and that plug terminal 1*b* further includes a second plurality of axially extending angularly displaced bores void of any electric connector means for fusible elements. This second plurality of bores houses the lower ends of mandrel rods 4 during the process of assembly of the fuse, and this second plurality of bores is filled with a pulverulent arc-quenching filler following withdrawal of rods 4 from the assembly.

All bores in the upper terminal plug 1*a* are plugged by screws when the casing of the fuse is completely filled with pulverulent arc-quenching filler.

It will be apparent from the drawings that plug terminals 1*a*, 1*b* are formed by blocks of metal whose diameter is large in comparison to the diameter of blind bores 3. It will further be apparent from FIGS. 5 and 6 that the end of spring 6 remote from the opening of blind bore 3, or adjacent the blind end thereof, is semi-spherical, i.e. has the shape of half a sphere.

I claim as my invention:

1. An electric fuse including a tubular casing of electric insulating material, a granular arc-quenching filler inside said casing, fusible element means inside said casing embedded in said filler, and a pair of plug terminals closing the ends of said casing and conductively interconnected by said fusible element means wherein the improvement comprises in that a. the axially inner end surfaces of said pair of plug terminals are provided with blind bores engaged by the axially outer ends of said fusible element means and also engaged by spring means tending to clamp said axially outer ends of said fusible element means against the lateral walls of said blind bores; and in that b. soft solder joints are formed inside said blind bores conductively connecting the axially outer ends of said fusible element means to said pair of plug terminals.

2. An electric fuse as specified in claim 1 wherein said spring means are substantially cylindrical and have a lateral slit coextensive with a generatrix thereof.

3. An electric fuse as specified in claim 2 wherein said substantially cylindrical spring means have a dome-shaped tip arranged adjacent the closed bottom ends of said blind bores, and wherein said lateral slit extends into said dome-shaped tip.

4. An electric fuse as specified in claim 1 wherein the axially inner end surfaces of said pair of plug terminals are provided with a plurality of angularly displaced additional bores which are unoccupied by ends of fusible element means.

5. An electric fuse as specified in claim 4 wherein the spacing of said blind bores and the spacing of said additional bores from the centers of said pair of plug terminals is equal.

6. A plug terminal for electric fuses including a. a cylindrical block of metal having a predetermined relatively large diameter;

b. at least one blind bore extending from one of the end surfaces of said block of metal to the inside thereof, said blind bore having a diameter substantially smaller than said predetermined diameter of said block of metal;

c. a ribbon fuse link having an end inserted into said bore and hugging the lateral wall thereof;

d. a substantially cylindrical expansion spring having a lateral slit coextensive with a generatrix thereof inserted into said bore and tending to cause engagement under pressure of said end of said ribbon fuse link with said lateral wall of said bore, said cylindrical spring having a semi-spherical end remote from the opening of said bore into which said end of said ribbon fuse link is inserted and adjacent the blind end of said bore; and e. a pair of soft solder joints extending along the lateral edges of said end of said ribbon fuse link inside said bore and conductively connecting said ribbon fuse link to said block of metal.

7. A plug terminal for electric fuses including a. a first plurality of axially extending angularly displaced bores;

b. a second plurality of axially extending angularly displaced bores;

c. each of said bores of said first plurality of bores accommodating one end of a plurality of helically wound fusible elements, a slotted expansion spring engaging said one end of said plurality of fusible elements, and soft solder joint means conductively connecting said one end of said fusible element to said plug terminal; and d. said second plurality of axially extending angularly displaced bores forming voids that do not contain electric connecting means for fusible elements.

8. A terminal plug as specified in claim 7 wherein said slotted expansion spring in each of said bores of said first plurality of bores has a dome-shaped slotted end.

* * * * *